US010647134B2

(12) United States Patent
Stafford et al.

(10) Patent No.: US 10,647,134 B2
(45) Date of Patent: May 12, 2020

(54) TRANSFER BELT PLATENS

(71) Applicants: Kabushiki Kaisha Toshiba, Minato-ku (JP); Toshiba TEC Kabushiki Kaisha, Shinagawa-ku (JP)

(72) Inventors: Don W. Stafford, Lexington, KY (US); Donn D. Bryant, Lexington, KY (US)

(73) Assignees: Kabushiki Kaisha Toshiba, Minato-ku (JP); Toshiba TEC Kabushiki Kaisha, Shinagawa-ku (JP)

( * ) Notice: Subject to any disclaimer, the term of this patent is extended or adjusted under 35 U.S.C. 154(b) by 167 days.

(21) Appl. No.: 15/903,100

(22) Filed: Feb. 23, 2018

(65) Prior Publication Data

US 2019/0263152 A1 Aug. 29, 2019

(51) Int. Cl.

| | |
|---|---|
| ***G03G 15/00*** | (2006.01) |
| ***G03G 15/16*** | (2006.01) |
| ***B41J 11/14*** | (2006.01) |
| ***B41J 13/054*** | (2006.01) |
| ***G03G 15/22*** | (2006.01) |

(52) U.S. Cl.

CPC ..... *B41J 11/14* (2013.01); *B41J 13/054* (2013.01); *G03G 15/1645* (2013.01); *G03G 15/225* (2013.01); *G03G 15/226* (2013.01); *G03G 2215/0122* (2013.01)

(58) Field of Classification Search

CPC ..... B41J 11/14; B41J 13/054; G03G 15/00; G03G 15/01; G03G 15/16; G03G 15/1645; G03G 15/225; G03G 15/226; G03G 21/00; G03G 2215/0122

See application file for complete search history.

(56) References Cited

U.S. PATENT DOCUMENTS

| | | | | |
|---|---|---|---|---|
| 6,192,207 | B1 * | 2/2001 | Yamamoto | G03G 15/01 399/299 |
| 6,408,145 | B1 * | 6/2002 | Ohki | G03G 15/01 399/176 |
| 7,706,703 | B2 * | 4/2010 | Sakuwa | G03G 15/0266 399/43 |
| 7,953,355 | B2 * | 5/2011 | Sawai | G03G 15/162 399/302 |
| 9,405,234 | B2 * | 8/2016 | Iida | G03G 15/1615 |
| 9,459,556 | B2 * | 10/2016 | Nodera | G03G 15/0886 |
| 2007/0014597 | A1 * | 1/2007 | Ishii | G03G 15/1685 399/310 |
| 2014/0212657 | A1 * | 7/2014 | Kanai | G03G 15/162 428/327 |

FOREIGN PATENT DOCUMENTS

| | | | | |
|---|---|---|---|---|
| JP | 03288173 A | * | 12/1991 | G03G 15/01 |

* cited by examiner

*Primary Examiner* — Nguyen Q. Ha
(74) *Attorney, Agent, or Firm* — Ulmer & Berne LLP

(57) ABSTRACT

A system and method for printing includes a transfer belt configured to transfer toner from a photoconductive drum of a toner-based printer to a paper. A transfer platen positions at least a portion of the transfer belt to be in proximity to a photoconductive drum. For color printing, a transfer platen is associated with a corresponding photoconductive drum for each distinct color of toner. The transfer platen is shaped to improve the transfer of toner from the photoconductive drum to the transfer belt. The transfer platen is substantially fixed in a non-rotatable position. The transfer platen includes electrically conductive foam. The transfer platen includes a low friction conductive top layer over the electrically conductive foam.

16 Claims, 4 Drawing Sheets

TRANSFER BELT PLATENS

TECHNICAL FIELD

This application relates generally to a transfer belt unit of a toner-based printer, and more particularly to a transfer belt unit that uses platens in place of transfer rollers.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

Toner-based print engines of MFPs utilize a transfer belt unit (TBU) as part of the printing function. Toner is selectively attracted onto one or more photoconductive drums of an electrostatic process unit (EPU) in accordance with an image to be printed. The transfer belt transfers the toner from the photoconductive drums onto the paper, after which the transferred toner is then fused by heat onto the paper and delivered to a tray for retrieval by a user.

In black and white printers, a single photoconductive drum is used, while in color printers four or more photoconductive drums are used. Each photoconductive drum successively places toner of a particular color, such as yellow, magenta, cyan, or black, onto the transfer belt in accordance with the image to be printed. After the transfer belt has passed each photoconductive drum, the transfer belt has the entire image to be printer which is then transferred to the paper and fused to the paper by heat.

In order to transfer the toner between a photoconductive drum and the transfer belt, the transfer belt is electrically charged and brought within close proximity to the photoconductive drum so that toner from the photoconductive drum is attracted to the transfer belt. To maintain positional accuracy of the transfer belt relative to the photoconductive drum, a transfer roller is placed against the transfer belt opposite to the photoconductive drum. Each transfer roller ensures that the transfer belt is close enough to the photoconductive drum to allow most, if not all, of the toner from the photoconductive drum to move onto the transfer belt.

However, transfer rollers require periodic maintenance as bearings can wear or become clogged with stray toner. Also, because each transfer roller has a fixed diameter, the placement of multiple transfer rollers in a color printer places design constraints on the printer which must accommodate all of the transfer rollers. Smaller transfer rollers can reduce design constraints. However, smaller transfer rollers have surfaces with greater arcs than larger transfer rollers. Smaller transfer rollers can reduce the area of the transfer belt that is immediately proximate to each photoconductive drum, which also has an arced surface, which can affect the effectiveness of the transfer of toner from the photoconductive drum to the transfer belt.

BRIEF DESCRIPTION OF THE DRAWINGS

Various embodiments will become better understood with regard to the following description, appended claims and accompanying drawings wherein:

SUMMARY

Figure 1:
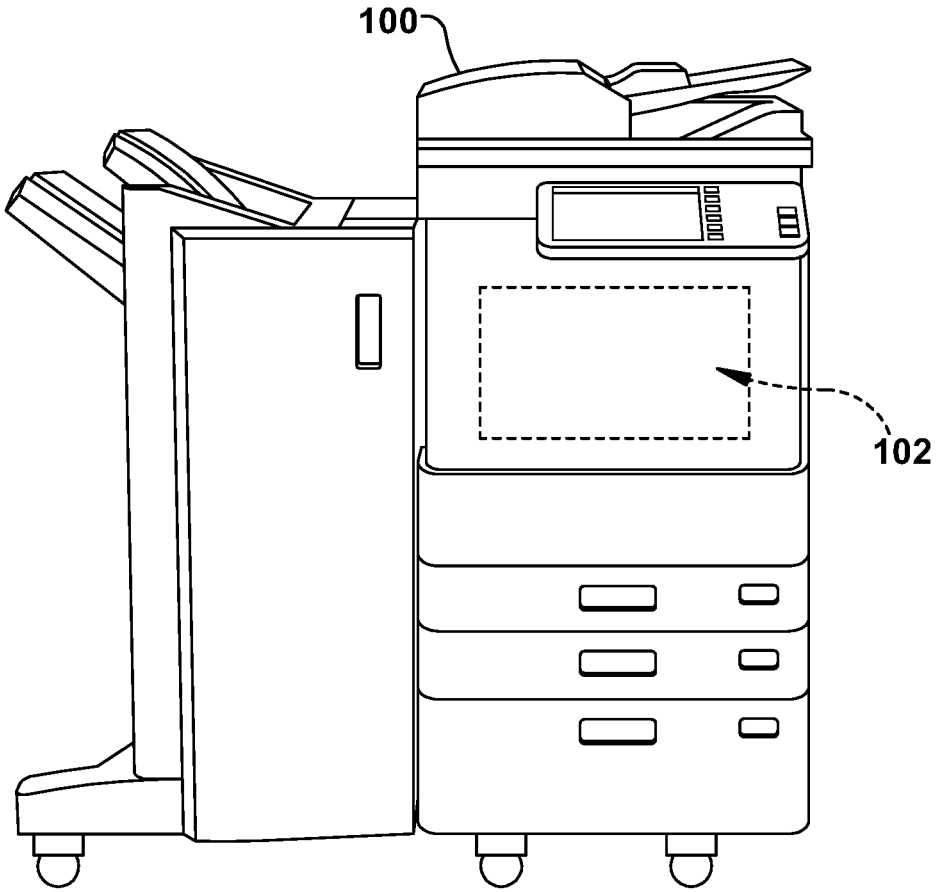
FIG. 1 is a block diagram of a multifunction peripheral.

In an example embodiment, a system and method for printing includes a transfer belt configured to transfer toner from a photoconductive drum of a toner-based printer to a paper. A transfer platen positions at least a portion of the transfer belt to be in proximity to the photoconductive drum.

In another more limited example embodiment, the system and method further includes a plurality of transfer platens, each associated with a corresponding photoconductive drum of an associated electrostatic process with each electrostatic process unit including a distinct color of toner.

In another more limited embodiment, the system and method includes a transfer platen that is substantially fixed in a non-rotatable position.

In another more limited embodiment, the system and method includes a transfer platen including electrically conductive foam.

In another more limited embodiment, the system and method includes a transfer platen comprised of a low friction conductive top layer over the electrically conductive foam.

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In toner-based electro-photographic printers, toner is picked up by a magnetic developer roller in an electrostatic process unit, or EPU, from a toner hopper. The magnetic developer roller rotates towards a photoconductive drum onto which an electric charge has been applied in accordance with a desired image to be printed, and toner from the magnetic developer roller is selectively transferred to the photoconductive drum. The toner is then transferred from the photoconductive drum to paper via a transfer belt and fused with the paper to form a printed page.

In black and white printers, a single photoconductive drum is used, while in color printers four or more photoconductive drums are used. Each photoconductive drum successively places toner of a particular color, such as yellow, magenta, cyan, or black, onto the transfer belt in accordance with the image to be printed. After the transfer belt has passed each photoconductive drum, the transfer belt has the entire image to be printer which is then transferred to the paper and fused to the paper by heat.

In order to transfer the toner between a photoconductive drum and the transfer belt, the transfer belt is electrically charged and brought within close proximity to the photoconductive drum so that toner from the photoconductive drum is attracted to the transfer belt. To maintain positional accuracy of the transfer belt relative to the photoconductive drum, a transfer roller is placed against the transfer belt opposite to the photoconductive drum. Each transfer roller ensures that the transfer belt is close enough to the photoconductive drum to allow most, if not all, of the toner from the photoconductive drum to move onto the transfer belt. Transfer belts are part of a removable unit called a transfer belt unit (TBU) that can include the transfer belt and transfer rollers.

With reference to FIG. 1, an example multifunction peripheral (MFP 100) is presented. The MFP 100 includes electrostatic-based, or toner-based, printing hardware 102 for performing printing operations. The hardware 102 includes electrostatic process units and a transfer belt unit as would be understood in the art.

Figure 2:
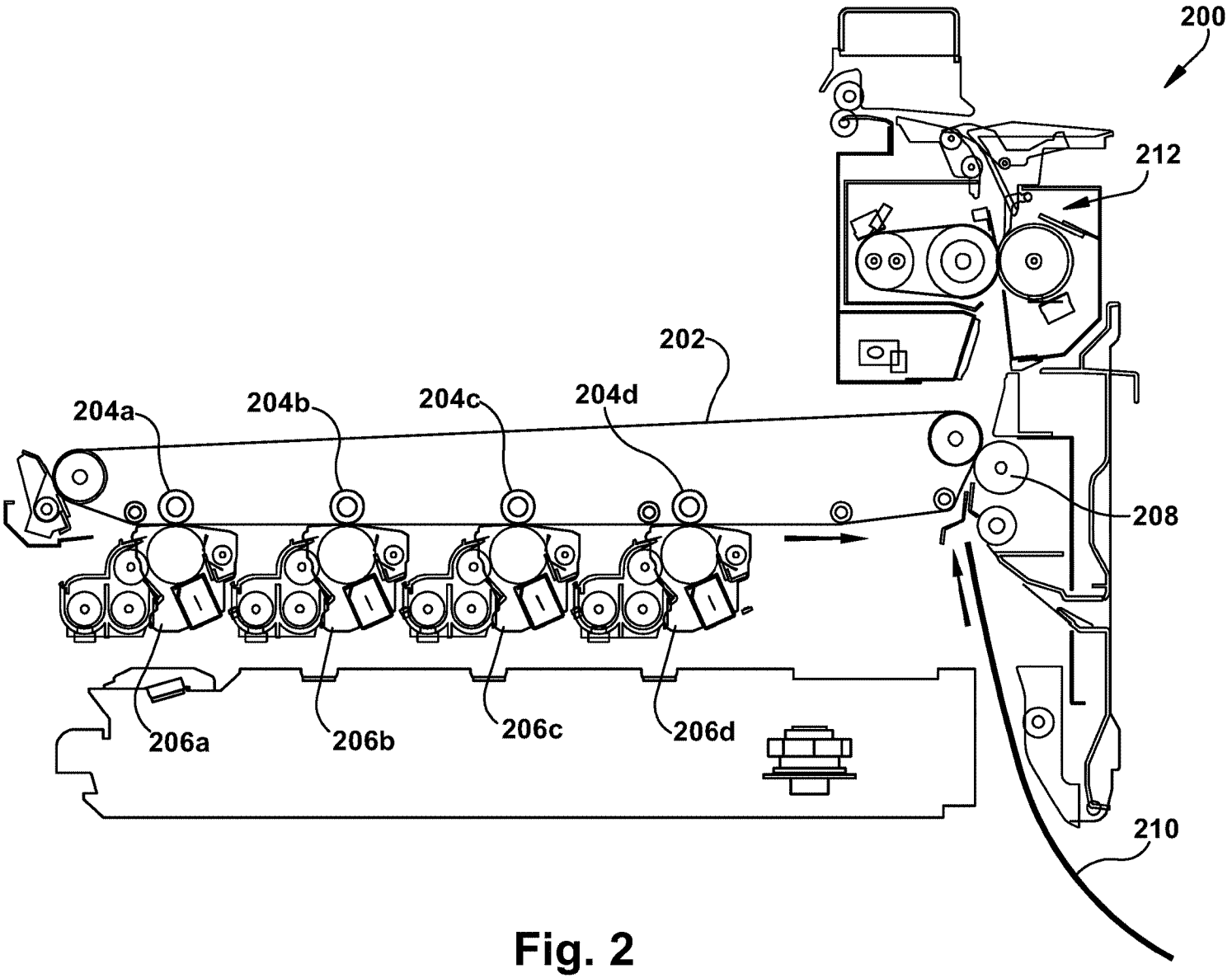
FIG. 2 is a diagram of a transfer belt, transfer rollers, and electrostatic process units of a multifunction peripheral.

With reference to FIG. 2, example printing hardware 200 of a CMYK color MFP is illustrated. The printing hardware 200 includes electrostatic print units (EPU) for each toner color, for example a yellow EPU 206*a*, a magenta EPU 206*b*, a cyan EPU 206*c*, and a black EPU 206*d* (collectively EPUs 206). The printing hardware 200 also includes a transfer belt unit (TBU) that includes the transfer belt 202, transfer rollers 204*a*, 204*b*, 204*c*, and 204*d* corresponding to each EPU. The printing hardware 200 also includes a second transfer roller that transfers toner from the transfer belt 202 to the paper 210 which is fused at fuser unit 212. Like any other moving part of a printer, parts of the TBU can become worn from use and generally have a limited useful life cycle. For example, transfer rollers 204 require periodic maintenance as bearings can wear or become clogged with stray toner.

Figure 3:
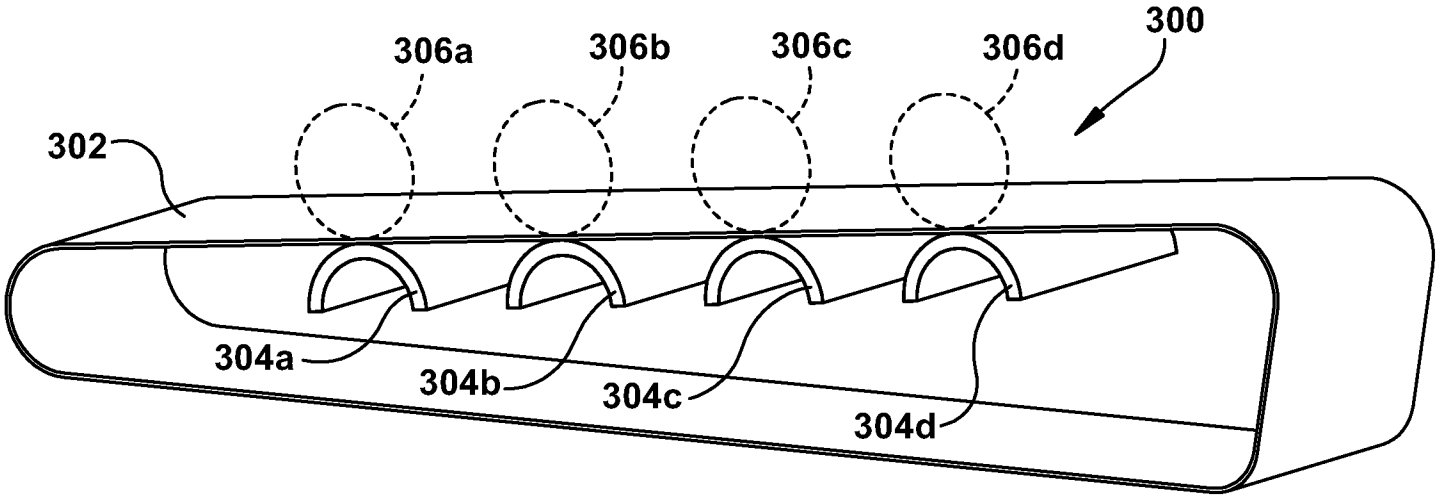
FIG. 3 is a diagram of an embodiment of a transfer belt unit with transfer platens.

With reference to FIG. 3 a diagram of a transfer belt unit with transfer platens, TBU 300, is illustrated. TBU 300 includes a transfer belt 302, and transfer platens 304*a*, 304*b*, 304*c*, and 304*d* (collectively transfer platens 304) corresponding to each photoconductive drum 306*a*, 306*b*, 306*c*, and 306*d* (collectively photoconductive drums 306) of each EPU. The transfer platens 304 take the place of transfer rollers (not present, see FIG. 2.)

The transfer platens 304 can be any suitable shape, for example semicircles as illustrated. Advantageously, transfer platens 304 can be shaped so as to substantially reduce the amount of space required in the TBU. For example, not only are the semicircles half the height of rollers, but they can be partially hollow. Also, semicircles use less material than full circles and do not require the bearings, which results in a substantially reduce weight of the transfer platen 304 when compared to standard transfer rollers. Further, because transfer rollers need to rotate to perform the required function, transfer rollers have geometries that are limited to cylinders of different sizes. Because transfer rollers and photoconductive drums 306 are both cylinders, there is a limit to what forces the transfer rollers can exert on the transfer belt 302 to bring the transfer belt 302 into proximity of the photoconductive drum 306 to effect efficient toner transfer. By comparison, transfer platens 304 can use geometries suitably configured to optimize toner transfer from the photoconductive drums 306 to the transfer belt 302. For example, the transfer platens 304 can be shaped to allow for larger or smaller contact areas as well as differently shaped contact profiles with the transfer belt 302 and photoconductive drums 306.

Further, unlike transfer rollers, transfer platens 304 have no moving parts, and therefore do not require bearings and other structures that can wear out, become clogged, or otherwise require maintenance. Because transfer platens 304 do not require bearings, transfer platens 304 can be used to replace more costly transfer rollers and associated bearings.

The shape of the transfer platens 304 can be select to optimize toner transfer from each photoconductive drum 306 to the transfer belt 302. In an embodiment, each transfer platen 304 is identically shaped. In an embodiment, the transfer platens 304 can be different shapes. In an embodiment, each transfer platen 304 can be independent of the other transfer platens 304. In an embodiment, one or more transfer platens 304 can be connected together or manufactured as a common unit.

Figure 4B:
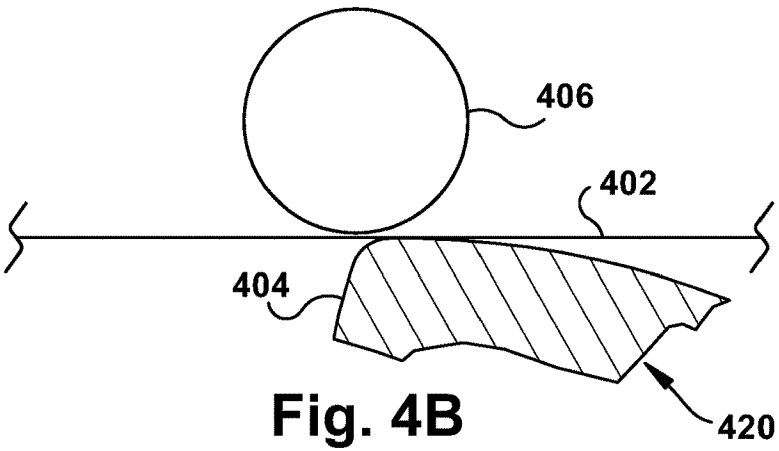
FIG. 4B is a diagram of a second embodiment of a transfer platen.
Figure 4D:
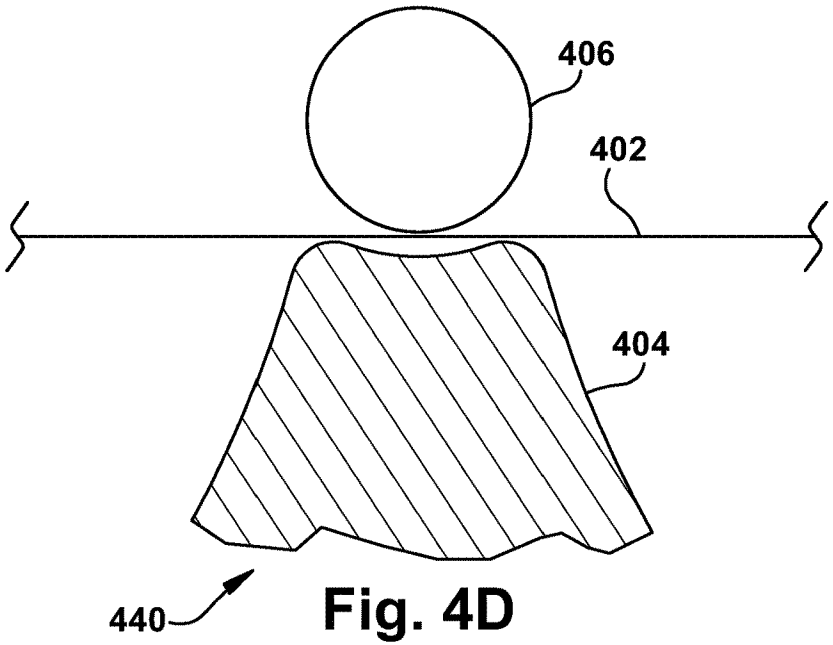
FIG. 4D is a diagram of a fourth embodiment of a transfer platen.
Figure 4A:
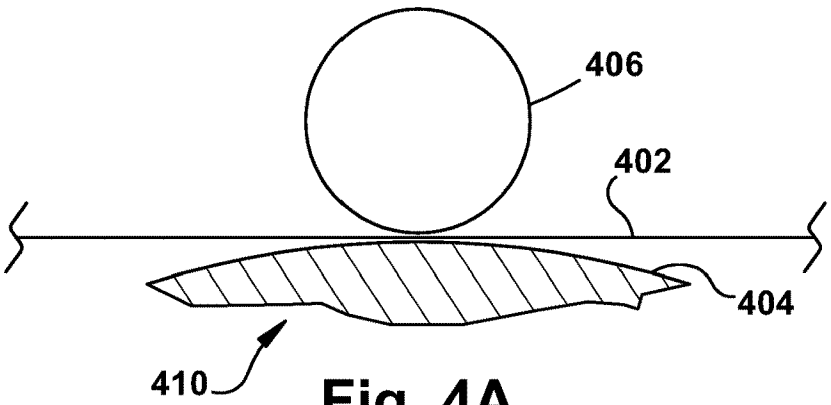
FIG. 4A is a diagram of a first embodiment of a transfer platen.
Figure 4C:
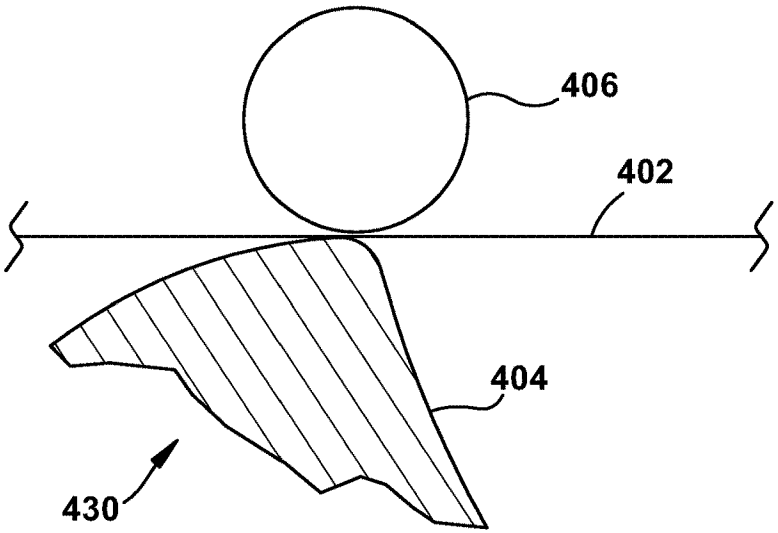
FIG. 4C is a diagram of a third embodiment of a transfer platen.

With reference to FIGS. 4A, 4B, 4C, and 4D, diagrams of example shapes 410, 420, 430, and 440 of platens 404 are presented. In FIGS. 4A, 4B, 4C, and 4D, the transfer platen 404 contacts a transfer belt 402 to urge the transfer belt 402 into proximity of the photoconductive drum 406 of an EPU (not shown, see FIG. 2.) In FIG. 4A, the shape 410 of the transfer platen 404 is an arc of a large radius cylinder, which would not be practical using an actual transfer roller. For example, for a given TBU, if the arc is large enough then a comparable transfer roller having a similar curvature as the arc of the transfer platen 404 would have a diameter that could not be totally contained with the TBU. In FIG. 4B, the shape 420 of the transfer platen 404 has a steep approach where the transfer platen 404 first contacts the transfer belt 402, and a more gradual descent where the transfer platen 404 releases contact with the transfer belt 402. In FIG. 4C, the shape 430 of the transfer platen 404 has a gradual approach where the transfer platen 404 first contacts the transfer belt 402, and a steeper descent where the transfer platen 404 releases contact with the transfer belt 402. By gradual or steeper, what is intended is a curvilinear profile that is less than or greater than the curvature of a comparable transfer roller. In FIG. 4D, the shape 440 of the transfer platen 404 includes an indentation between two opposing curvilinear protrusions where the transfer platen 404 contacts the transfer belt 402. Note that the example shapes 410, 420, 430, and 440 of the platens 404 FIGS. 4A, 4B, 4C, and 4D are drawn for purposes of illustration only and are not drawn to scale. The transfer platen allow the use of other shapes can be used to effect efficient transfer of toner from the photoconductive drums 406 to the transfer belt 402 when compared to comparable transfer rollers.

Figure 5:
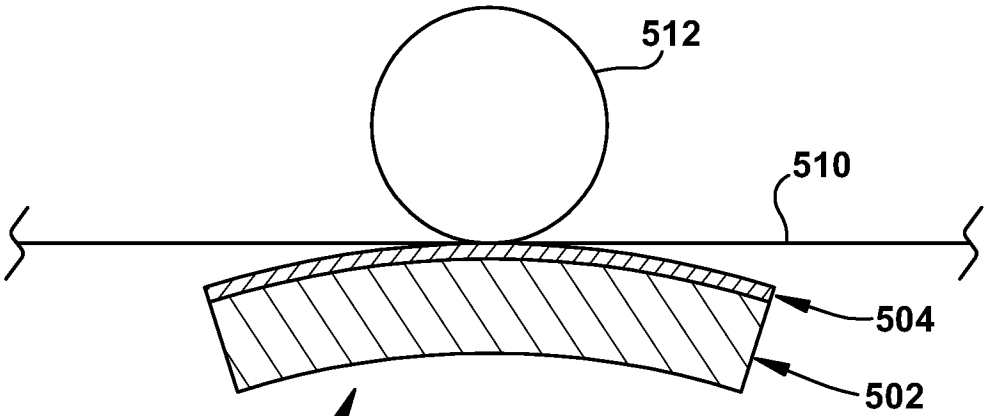
FIG. 5 is a cross-section diagram of an embodiment of transfer platen.

With reference to FIG. 5, a cross-section diagram of a transfer platen 500 is presented. The transfer platen 500 includes a layer of electrically conductive foam 502 for compliance with the transport belt 510 and photoconductive drum 512. For example, the electrically conductive foam 502 can be made of the same foam material currently used in transport rollers. A low friction conductive top layer 504 can be placed on top of the electrically conductive foam 502. Example low friction materials include polytetrafluoroethylene (PTFE, or Teflon) and polyethylene terephthalate (PET), among other suitable materials. In an embodiment, each transfer platen 500 can be manufactured from the same materials as other transfer platens 500. In an embodiment, one or more transfer platens 500 can be manufactured from different materials. In an embodiment, one or more transfer platens 304 can be connected together or manufactured as a common unit.

In light of the foregoing, it should be appreciated that the present disclosure significantly advances the art of transfer belt units for toner-based printers. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a transfer belt configured to transfer toner from a photoconductive drum of a toner-based printer to a paper; and a transfer platen configured to position at least a portion of the transfer belt in proximity to a photoconductive drum of the toner-based printer, wherein the transfer platen includes a portion in proximity to the photoconductive drum that is indented relative to other portions of the transfer platen.

2. The apparatus of claim 1, further comprising:

a plurality of transfer platens, each transfer platen being associated with a corresponding photoconductive drum of an associated electrostatic process unit, wherein each electrostatic process unit includes a distinct color of toner.

3. The apparatus of claim 1, wherein the transfer platen is substantially fixed in a non-rotatable position.

4. The apparatus of claim 1, wherein a cross sectional shape of the transfer platen is approximately an arc of a large radius cylinder that is larger than an arc of a comparable transfer roller.

5. The apparatus of claim 1, wherein the transfer platen includes a portion approaching the photoconductive drum that is steeper than an arc of a comparable transfer roller.

6. The apparatus of claim 1, wherein the transfer platen includes a portion approaching the photoconductive drum that is more gradual than an arc of a comparable transfer roller.

7. The apparatus of claim 1, wherein the transfer platen includes a portion descending away from the photoconductive drum that is steeper than an arc of a comparable transfer roller.

8. The apparatus of claim 1, wherein the transfer platen includes a portion descending away from the photoconductive drum that is more gradual than an arc of a comparable transfer roller.

9. An apparatus comprising:

a transfer belt configured to transfer toner from a photoconductive drum of a toner-based printer to a paper, and a transfer platen configured to position at least a portion of the transfer belt in proximity to the photoconductive drum, wherein the transfer platen comprises an electrically conductive foam.

10. The apparatus of claim 9, wherein the transfer platen comprises a low friction conductive top layer over the electrically conductive foam.

11. The apparatus of claim 10, wherein the low friction conductive top layer is selected from the group consisting of polytetrafluoroethylene and polyethylene terephthalate.

12. A transfer belt unit, comprising:

a transfer belt configured to transfer toner from a photoconductive drum of a toner-based printer to a paper during a print operation; and at least one transfer platen configured to position at least a portion of the transfer belt in proximity to a photoconductive drum of the toner-based printer, wherein each transfer platen comprises a low friction conductive first layer in communication with an electrically conductive foam second layer.

13. The transfer belt unit of claim 12, wherein each transfer platen is substantially fixed in a non-rotatable position.

14. The transfer belt unit of claim 12, wherein a cross sectional shape of each transfer platen is selected from the group consisting of an arc of a large radius cylinder, a steep approach followed by a gradual descent, a gradual approach followed by a steep descent, and a curvilinear approach followed by an indentation followed by a curvilinear descent.

15. The transfer belt unit of claim 12, wherein the low friction conductive first layer is selected from the group consisting of polytetrafluoroethylene and polyethylene terephthalate.

16. The transfer belt unit of claim 12, further comprising:

a plurality of rollers configured to move the transfer belt in a loop over the transfer platen.

* * * * *